US008636030B2

(12) United States Patent
Maini et al.

(10) Patent No.: US 8,636,030 B2
(45) Date of Patent: Jan. 28, 2014

(54) ARM TO DISTRIBUTE CONCRETE AND RELATIVE PRODUCTION METHOD

(75) Inventors: Paolo Dario Maini, Monza (IT); Nicola Pirri, Milan (IT)

(73) Assignee: CIFA SpA, Senago (MI) (IT)

( * ) Notice: Subject to any disclaimer, the term of this patent is extended or adjusted under 35 U.S.C. 154(b) by 249 days.

(21) Appl. No.: 13/044,921

(22) Filed: Mar. 10, 2011

(65) Prior Publication Data

US 2011/0220228 A1 Sep. 15, 2011

(30) Foreign Application Priority Data

Mar. 12, 2010 (IT) ..... UD2010A0045

(51) Int. Cl.
*F17D 1/08* (2006.01)

(52) U.S. Cl.
USPC ..... 137/615; 141/387

(58) Field of Classification Search
USPC ..... 137/351, 615, 899; 141/387; 222/527; 212/177, 296, 300, 347, 348, 350; 403/334, 331, 383; 52/632, 843, 118, 52/119, 836, 844, 847, 848, 111, 114, 116, 52/117
See application file for complete search history.

(56) References Cited

U.S. PATENT DOCUMENTS

| | | | | |
|---|---|---|---|---|
| 3,947,191 | A | 3/1976 | Milner, Jr. | |
| 4,069,637 | A * | 1/1978 | Braithwaite | 212/114 |
| 4,828,033 | A * | 5/1989 | Frison | 137/615 |
| 5,245,770 | A * | 9/1993 | Ko et al. | 264/46.5 |
| 5,913,323 | A * | 6/1999 | Hudelmaier | 137/615 |
| 6,698,451 | B2 * | 3/2004 | Anderson et al. | 137/615 |
| 6,719,009 | B1 * | 4/2004 | Bissen et al. | 137/615 |
| 6,755,212 | B1 * | 6/2004 | Anderson et al. | 137/615 |
| 6,786,233 | B1 | 9/2004 | Anderson et al. | |
| 6,823,888 | B1 * | 11/2004 | Raymond | 137/615 |
| 7,128,094 | B2 * | 10/2006 | Anderson et al. | 137/615 |
| 7,781,039 | B2 * | 8/2010 | Anderson et al. | 137/615 |
| 8,082,083 | B2 * | 12/2011 | Pirri et al. | 701/50 |
| 2005/0011604 | A1 * | 1/2005 | Anderson et al. | 156/173 |
| 2008/0309114 | A1 * | 12/2008 | Monteiro | 296/72 |
| 2010/0230371 | A1 * | 9/2010 | Pirri et al. | 212/347 |

FOREIGN PATENT DOCUMENTS

| | | |
|---|---|---|
| EP | 1970344 A1 | 9/2008 |
| EP | 2039498 A2 | 3/2009 |

OTHER PUBLICATIONS

IT Search Report issued on Nov. 2, 2010 in IT Application No. UD20100045.

* cited by examiner

*Primary Examiner* — Craig Schneider
*Assistant Examiner* — Craig J Price
(74) *Attorney, Agent, or Firm* — Panitch Schwarze Belisario & Nadel LLP

(57) ABSTRACT

An arm to distribute concrete comprising a plurality of articulated segments selectively able to be folded back and extended with respect to each other, made of composite material, wherein at least one of said segments comprises at least a first tract and a second tract, each having a constant cross section, wherein the section size of the first tract is different from the section size of the second tract, a connection tract being provided between said first tract and said second tract.

10 Claims, 4 Drawing Sheets

22
23
25

29
27
W
H1
H2

B2
B1

Z
T

ARM TO DISTRIBUTE CONCRETE AND RELATIVE PRODUCTION METHOD

FIELD OF THE INVENTION

The present invention concerns an arm to distribute concrete and the relative production method.

In particular, the present invention is applied on articulated arms used to pump concrete in operating machines such as, for example, pumps transported on trucks, pumps on concrete mixers and even more in particular in all those cases in which it is required that the arms of such vehicles reach great total heights and/or lengths, supporting considerable weight.

BACKGROUND OF THE INVENTION

Arms for the distribution of concrete are known, mounted on heavy work vehicles used in the building sector, consisting of a plurality of segments which allow them to reach the greatest lengths and distances.

Some segments of the known type, as described in the European patent application EP-08152672.5 in the name of the present Applicant, are at least partly made of composite material which, given the same extension reached with respect to a traditional arm made of metal material, allow an overall reduction in the weight of the arm. This because composite material has good resistance and rigidity, to which can be added a greater lightness.

Such segments normally have a rectangular section which narrows substantially continuously along its whole extension. The segments can also comprise longitudinal or transverse stiffening and/or connection elements, made of metal or composite material, which connect to specific elements which are glued or drowned in the structure of the main beam directly during the production step of the segment.

Based on the idea of using composite material to construct the articulated arm, the European patent application EP-08164624.2, also in the name of the present Applicant, shows a possible construction technique of such an arm, which aims to reduce its production costs, guaranteeing a greater flexibility and versatility of manufacturing.

According to this technique segments of articulated arms are made, in which the sizes of the transverse section of the segment are constant along its whole extension.

The segments are formed by depositing a predefined plurality of layers of composite material subsequently subjected to polymerization.

The forming mold used advantageously consists of a plurality of elementary molds of constant section, connected to each other in sequence, for example flanged, and in the number desired to obtain the desired length.

The molds, which are all identical to each other, can be made starting from the same model, with obvious savings.

This solution allows to obtain a constant section on the whole length of the segment and therefore does not allow to reproduce the traditional concept of reduction of the section over the length of the segment.

One purpose of the present invention is to obtain significant reductions in production costs, in particular in the design and construction of the relative molds and models, and to allow maximum flexibility and versatility in production for assembly on different types of vehicles depending on the specific requirements, as well as to allow to obtain a section which varies over its length.

Another purpose is to allow great flexibility in the choice of length, resistance and rigidity of the segments of the arm, allowing to vary on each occasion one and/or the other of said parameters depending on the specific needs and requirements.

A further purpose is to optimize the distribution of the composite material along the extension of the segment depending on the stresses to which it is subjected, in this way obtaining an optimum compromise between mechanical resistance of the segment and distribution of the polymeric material along the whole extension of the segment.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

In accordance with the above purpose, an arm to distribute concrete comprises a plurality of articulated segments selectively able to be folded and extended with respect to each other, made of composite material.

According to the invention, at least one of the segments comprises at least a first tract and a second tract, each having a constant cross section in which the section size of the first tract is different from the section size of the second tract and a connection tract is provided between the first tract and the second tract.

In this way the first tract and the second tract can be sized in a targeted way to resist variable inflectional stresses along the extension of the segment which, for example, are different at the different ends of the segment.

In a particular form of embodiment, the cross sections are a rectangular shape.

In other forms of embodiment it is possible to provide that the cross sections are square, or polygonal with five or more sides, or circular or oval.

According to one form of embodiment of the invention, the first tract, the second tract and the connection tract have a thickness of the cross sections that is uniform along their extension.

In an alternative form of embodiment to the one described above, the thickness of the cross sections varies, in a desired manner, along the extension of the segment.

A preferential form of embodiment provides that the first tract and the second tract extend along a common axis.

In this case the connection tract has a symmetrical development with respect to the axis.

According to a variant, the first tract and the second tract extend along parallel axes.

According to a further form of embodiment of the invention, the first tract and the second tract extend along axes which are angled with respect to each other.

In some forms of embodiment, at least one of the segments has holes, and/or other attachment devices suitably conformed to connect accessory and/or auxiliary elements.

The holes present at the ends of one segment also allow it to be hinged to the subsequent articulated segment.

In proximity to the holes and/or attachment devices the section has a thickening with the purpose of strengthening the zone.

The present invention also concerns the production method, comprising a first step of setting up a forming mold, a second step of molding the segment by means of deposition, a third step of polymerizing composite material, a fourth step of extracting the segment thus obtained from the mold, a fifth step of applying accessory elements and a sixth step of connecting the segments and/or other accessory elements and of setting up the same on a vehicle.

In particular the mold comprises at least a first sub-mold and a second sub-mold, each having a constant and reciprocally different section along their extension, and a third sub-mold interposed between the first and second sub-mold.

The first sub-mold, second sub-mold and third sub-mold consist of a plurality of elements that are connectable with respect to each other in a desired number depending on the overall length of the segment to be made.

This allows to set up forming molds of segments in which the sizes vary depending on the specific application for which the articulated arm is intended, greatly reducing the production costs of molds dedicated for that type of segment.

BRIEF DESCRIPTION OF THE DRAWINGS

These and other characteristics of the present invention will become apparent from the following description of a preferential form of embodiment, given as a non-restrictive example with reference to the attached drawings wherein.

Figure 1:
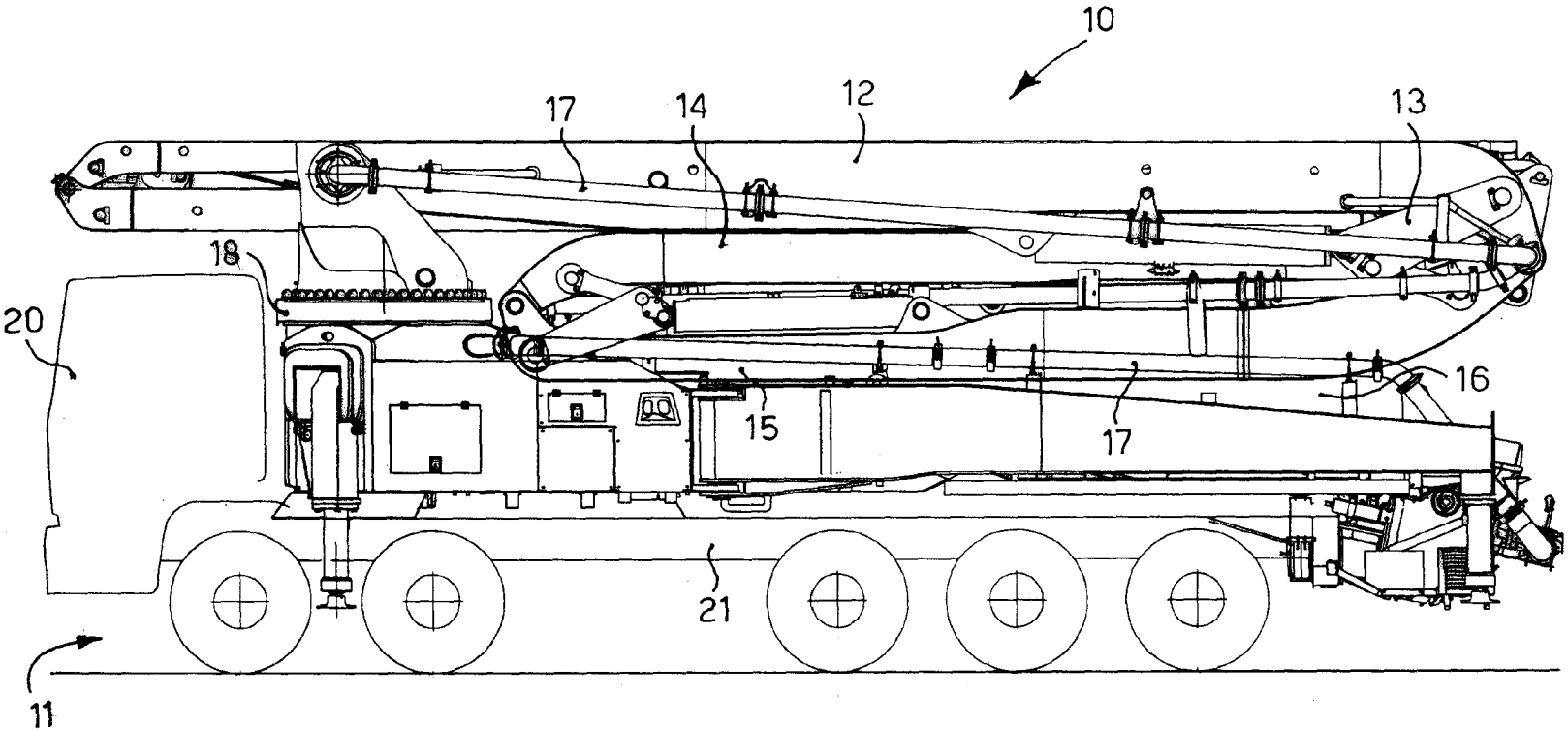
FIG. 1 is a lateral view of a work vehicle on which an articulated arm of composite material according to the present invention has been installed, in a folded operating condition for transport.

To facilitate comprehension, the same reference numbers have been used, where possible, to identify common elements in the drawings that are substantially identical. It is understood that elements and characteristics of one form of embodiment can conveniently be incorporated into other forms of embodiment without further clarifications.

DETAILED DESCRIPTION OF A PREFERENTIAL FORM OF EMBODIMENT

With reference to FIG. 1, an articulated arm 10 according to the present invention, able to distribute concrete or similar material for the building trade, is shown in a mounted position on a work vehicle 11, in a folded condition for transport.

The vehicle 11 comprises the driver's cabin 20 and a support platform 21 on which the articulated arm 10 is mounted.

The arm 10 according to the present invention comprises a plurality of articulated segments, in this case five, respectively a first 12, a second 13, a third 14, a fourth 15 and a fifth 16, pivoted with respect to each other at the respective first and second ends 30 and 31. There is also a pipe 17 to feed and unload the concrete. In a known manner, and with systems not shown here, the combined articulated segments 12-16 can be rotated, by as much as 360°, with respect to the axis of the vehicle 11.

With reference to FIG. 1, the first segment 12 is pivoted in a known manner to a turret 18, and can be rotated with respect thereto. The other segments 13-16 are sequentially pivoted with respect to each other at respective ends and can be driven individually, by means of their own actuators, according to specific needs.

Each segment 12-16 serves to carry a pipe inside which the concrete is made to flow, sent by a feed pump (not shown). A section of flexible pipe (not shown) is normally connected to the last segment, from which the concrete is delivered into the place of application.

It is understood the representation in FIG. 1 is only an example and must in no way be understood as restrictive of the field of protection to which the present invention is applied.

According to the invention, one or other of the segments 12-16 is at least partly made of composite material, preferably reinforced, for example carbon fiber, single layered or multi-layered. The possible number of layers depends on the mechanical features that the arm 10 has to have.

Instead of or together with the carbon fibers, fibers of a different type can be used, for example aramid fibers, or others of a similar or comparable type, in a uni-directional form or plaited/interwoven.

Figure 2:
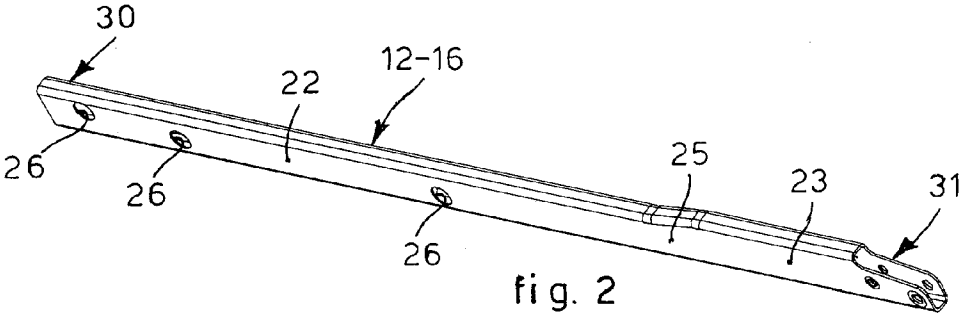
FIG. 2 is a three dimensional view of a segment of composite material which forms the articulated arm.

With reference to FIG. 2, a possible form of embodiment of a segment 12-16 is shown, which comprises a first tract 22, a second tract 23 and an intermediate connection tract 25 between the first tract 22 and the second tract 23.

In this case, the segment 12-16 has a substantially rectangular section the sizes of which are reduced by means of the connection tract 25, from the first tract 22 to the second tract 23. It comes within the field of the present invention that the section can be square or polygonal with more or less rounded corners, oval, or with other section suitable for the purpose.

Figure 3:
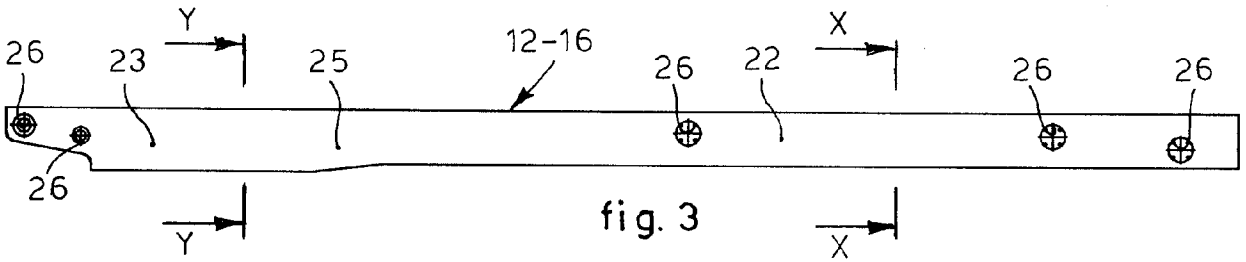
FIG. 3 is a lateral view of a segment of composite material in FIG. 2.
Figure 3B:
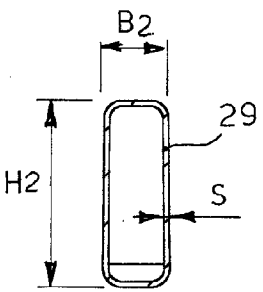
FIG. 3*b* is a section from Y to Y of the segment in FIG. 3.
Figure 3A:
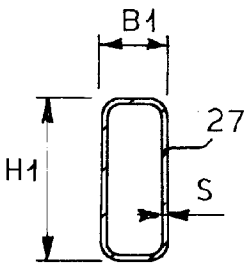
FIG. 3*a* is a section from X to X of the segment in FIG. 3.

With reference to FIG. 3 and to the relative section view of FIG. 3*a* obtained by sectioning along a section line X-X, the first tract 22 has a first cross section 27 of a hollow rectangular shape, with height H1, width B1 and thickness S which are substantially uniform along the whole extension of the first tract 22. The first tract 22 also has holes 26 which provide for the connection of movement jacks, of other segments 12-16 and/or of other accessory or auxiliary elements for the functioning of the segments 12-16.

The holes 26 can be provided with bushings made of metal material which are inserted in the holes 26 or are drowned inside the thickness of the segment during the production step, allowing to strengthen the zone.

The second tract 23 has a second hollow rectangular cross section 29 of different sizes with respect to the first section 27, that is, with width B2, height H2 and thickness S. In this case the width B2 and the width B1 are the same, and also the thickness S of the section is kept unchanged along the whole extension of the segment 12-16.

In other forms of embodiment the thickness S can vary along the extension of the segment according to the needs of resistance required for that segment zone.

In proximity to the second end 31, holes are made which allow the attachment, between them, of the segments 12-16, or its attachment to the turret 18.

The connection tract 25 acts as a connection portion between the first tract 22 and the second tract 23. The thickness of the connection tract 25 is equal to the thickness S of the first and the second section 27, 29; the size and shape of the cross section of the connection tract 25 vary progressively from the size and shape of the first section 27 to the size and shape of the second section 29.

Figures 4, 5, 5A, 5B, 5C, 6, 6A, 6B, 6C:
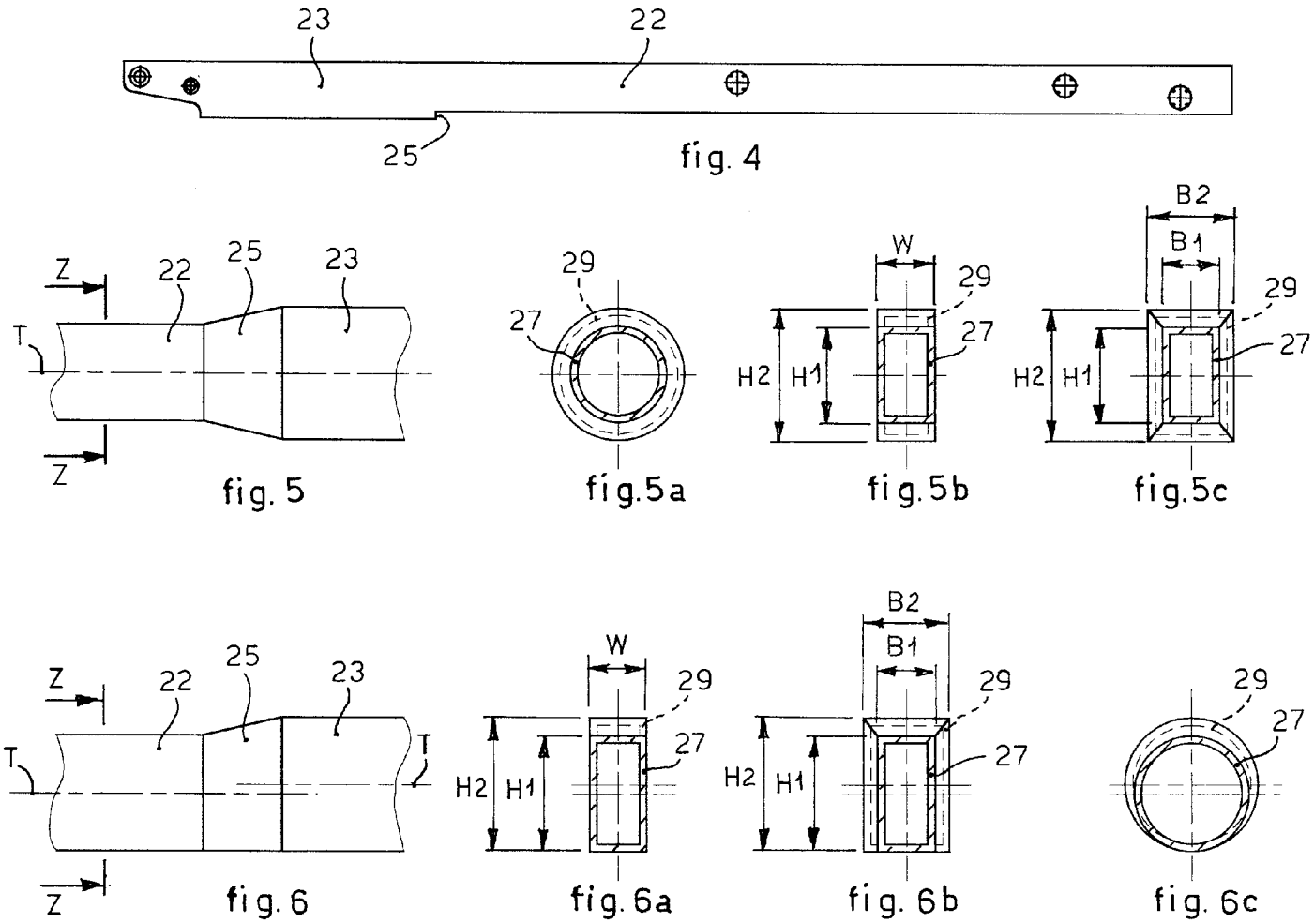
FIG. 4 is a lateral view of a variant of the segment of composite material in FIG. 3.
FIG. 5 is a lateral view of a portion of the segment of composite material in FIG. 3 according to a further variant.
FIGS. 5*a*, 5*b*, 5*c* are views of some possible sections obtained by sectioning the segment in FIG. 5 from Z to Z.
FIG. 6 is a lateral view of a portion of the segment of composite material in FIG. 3 according to a further variant.
FIGS. 6*a*, 6*b*, 6*c* are views of some possible sections obtained by sectioning the segment in FIG. 6 from Z to Z.

In another form of embodiment of the present invention, shown in FIG. 4, the segment 12-16 has the first tract 22 and the second tract 23 directly connected to each other, the connection tract 25 is confined to only connecting the first tract 22 and the second tract 23, that is, it is represented by the abutment element.

According to other forms of embodiment, the connection element 25 can be more or less angled or more or less extended with respect to the overall length of the segment 12-16, and can also represent connections between the first and the second section.

The shape and sizes of the first section 27 and the second section 29 can be different depending on the particular needs of the embodiment.

With reference to FIG. 5, a front view of a portion of the segment 12-16 is shown, in which the first tract 22 and the second tract 23 extend along an axis T common to both, and in which the connection tract 25 allows the progressive connection of the two tracts.

The FIGS. 5*a*, 5*b*, 5*c* show some of the possible cross sections obtained by sectioning the first tract 22 of FIG. 5 along a section line Z-Z.

In particular, in FIG. 5*a* there is a progressive passage from the first section 27 in the form of a circular ring, to the second section 29, also in the form of a circular ring but with the size of the second section 29 greater than the first section 27.

In FIG. 5*b* the first section 27 and the second section 29 have a substantially hollow rectangular shape and maintain the width B unchanged, while the height H1 of the first section 27 is less than the height H2 of the second section 29.

An alternative form of FIG. 5*b* is shown in FIG. 5*c*, where both the height H1 and the width B1 of the first section 27 are progressively increased to height H2 and width B2 of the second section 29.

With reference to FIG. 6, on the contrary, a further form of embodiment of the segment 12-16 is shown, in which the first tract 22 and the second tract 23 extend along parallel rectilinear axes (T) but which are not common with respect to each other.

FIGS. 6*a* and 6*b* show possible cross sections of the first tract 22 and the second tract 23 corresponding to the front view of FIG. 6 obtained by sectioning the first tract 22 along a section line Z-Z.

In particular, FIG. 6*a* shows a first section 27 and a second section 29 with a hollow rectangular shape and having a uniform width W, while the connection tract 25 passes from a height H1 of the first section 27 to a height H2 of the second section 29 which is greater than the height H1. In this way the size of the first section 27 is less than the size of the second section 29.

According to other forms of embodiment of the invention the width W can be different between the first and the second section 27, 29. Or (FIG. 6*b*) the first section 27 has a width B1 and a height H1 which are both less than the width B2 and the height H2 of the second section 29.

In FIG. 6*c* a further form of embodiment is shown in which both the first section 27 and the second section 29 have a circular ring shape and in which the centers of the sections are not centered with respect to each other.

Figure 7:
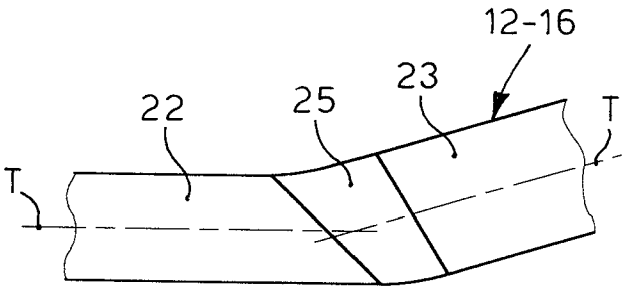
FIG. 7 is a lateral view of a portion of the segment of composite material in FIG. 3 according to a further variant.

In another form of embodiment (FIG. 7), the segment 12-16 comprises a first tract 22 and a second tract 23 in which the respective axes (T) are angled with respect to each other. It is clear that the angles between the first tract 22 and the second tract 23 can be different, and the connection tract 25 makes the connection between them.

It is understood that the representations in FIGS. 5, 5*a*, 5*b*, 5*c*, 6, 6*a*, 6*b*, 6*c* and 7 are only examples, and must in no way be understood as restrictive of the field of protection to which the present invention is applied, inasmuch as it is possible to provide many other forms of the sections of the first and second tract 22 and 23 which can be combined with each other, just as it is also possible to provide that the thickness S of the sections can vary in a desired manner along the extension of the first tract 22 and/or the second tract 23 and/or the intermediate tract 25.

Figure 8:
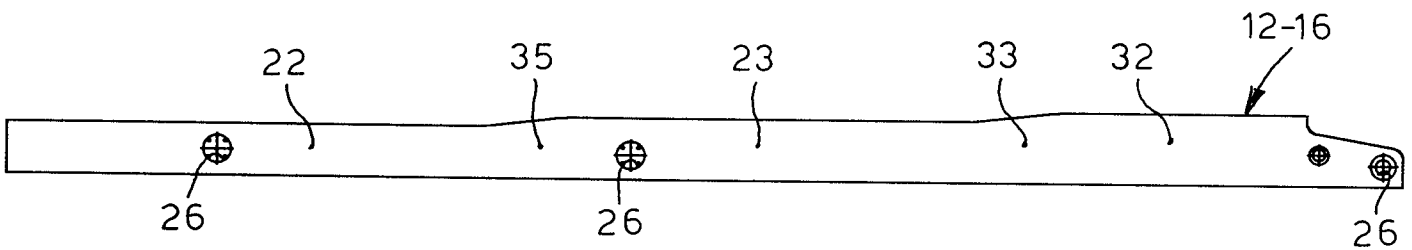
FIG. 8 is a lateral view of a variant of FIG. 3.

With reference to FIG. 8 a further form of embodiment of the present invention is shown which provides that the segment 12-16 can be subjected to several section variations.

In this case the segment 12-16 comprises a first tract 22, a second tract 23 and a third tract 32.

A first connection tract 35 is interposed between the first tract 22 and the second tract 23.

A second connection tract 33 is interposed between the second tract 23 and the third tract 32.

In this case too, the segment 12-16 is provided with holes 26 to attach other accessory elements which are not shown in the drawing.

The present invention also concerns a method to make the articulated arm 10.

In particular, in order to make a segment 12-16 which constitutes the articulated arm 10 with the characteristics shown above, it is provided to use female forming molds of the modular type.

It is in fact provided to use at least three types of mold, suitably connected to each other, for example by means of flanged joints.

A first mold defining in negative the shape of the section of the first tract, a second mold defining in negative the shape of the second mold and a third mold, interposed between the first mold and the second mold, defining in negative the shape of the connection tract.

In order to increase the flexibility of production of the segments and therefore to obtain segments of different lengths depending on the application requirements, the first mold and the second mold consist of a plurality of sub-molds of similar sizes and constant section which can be connected in sequence with each other, for example by means of flanged joints, until the predefined length of the first or the second tract 22, 23 is obtained.

The advantage of using sub-molds is that the same sub-molds can be used, suitably connected with each other and in a variable number, to make segments 12-16 with different sizes with respect to each other, but having tracts with the same section. In this way the same sub-molds can be used to make parts of segments belonging to articulated arms of different classes, and to choose, depending on the case, the suitable sub-molds defining the connection tracts. This therefore allows a reduction in the number of molds needed to produce different size segments, also reducing costs.

The possibility is not to be excluded, according to other forms of embodiment, that the third mold too consists of a plurality of sub-molds, suitably connected with each other in order to define, when installed, the negative of the connection tract 25.

The method to make a segment 12-16 of the articulated arm 10 comprises at least a first step of setting up the forming mold according to the sizes defined by the geometry of the segment 12-16, a second step of molding the segment 12-16 by means of depositing, with known modalities, a plurality of layers of pre-impregnated composite material in the forming mold according to a number of variable layers depending on the desired resistance and/or rigidity of the segment 12-16 to be obtained, a third step in which the composite material is polymerized using known techniques, a fourth step of removing the segment 12-16 thus obtained from the mold, a fifth step of applying all the accessory elements and a sixth step of connecting the segments 12-16 and setting up the same on the vehicle 11.

It is clear that modifications and/or additions of parts may be made to the articulated arm to distribute concrete and to the relative production method as described heretofore, without departing from the field and scope of the present invention.

It is also clear that, although the present invention has been described with reference to some specific examples, a person of skill in the art shall certainly be able to achieve many other equivalent forms of arm to distribute concrete and relative production method, having the characteristics as set forth in the claims and hence all coming within the field of protection defined thereby.

The invention claimed is:

1. An arm to distribute concrete comprising a plurality of articulated segments selectively able to be folded back and extended with respect to each other, each segment being made of composite material, wherein at least one of said segments comprises at least a first tract and a second tract, each of the first and second tracts having a constant cross section, wherein a section size of the first tract is different from a section size of the second tract, a connection tract being provided between said first tract and second tract.

2. The arm to distribute concrete as in claim 1, wherein said cross sections are substantially rectangular.

3. The arm to distribute concrete as in claim 1, wherein the first tract, the second tract and the connection tract have a thickness of the cross sections that is uniform along their extension.

4. The arm to distribute concrete as in claim 1, wherein the first tract, the second tract and the connection tract have a thickness of the cross sections that is variable along their extension.

5. The arm to distribute concrete as in claim 1, wherein the first tract and the second tract extend along a common axis.

6. The arm to distribute concrete as in claim 1, wherein the first tract and the second tract extend along axes that are parallel with respect to each other.

7. The arm to distribute concrete as in claim 1, wherein the first tract and the second tract extend along axes that are angled with respect to each other.

8. The arm to distribute concrete as in claim 1, wherein at least one of said segments has holes to connect accessory and/or auxiliary elements.

9. The arm to distribute concrete as in claim 1, wherein each articulated segment is void of metallic material.

10. The arm to distribute concrete as in claim 9, wherein each articulated segment is void of welding.

* * * * *